US006386738B1

(12) United States Patent
Staudacher

(10) Patent No.: US 6,386,738 B1
(45) Date of Patent: May 14, 2002

(54) LAMPHEAD

(75) Inventor: Peter Staudacher, Riedering (DE)

(73) Assignee: Arnold & Richter Cine Technik GmbH & Co. Betriebs KG, Munich (DE)

( * ) Notice: Subject to any disclaimer, the term of this patent is extended or adjusted under 35 U.S.C. 154(b) by 0 days.

(21) Appl. No.: 09/426,986

(22) Filed: Oct. 26, 1999

(30) Foreign Application Priority Data

Oct. 29, 1998 (DE) ..... 298 19 688 U

(51) Int. Cl.[7] ..... F21V 21/00
(52) U.S. Cl. ..... 362/374; 362/375; 362/455
(58) Field of Search ..... 362/374, 375, 362/293, 455

(56) References Cited

U.S. PATENT DOCUMENTS

| | | | | |
|---|---|---|---|---|
| 1,902,991 A | | 3/1933 | Cardon | |
| 2,056,153 A | * | 10/1936 | Belson | 362/375 |
| 2,878,374 A | * | 3/1959 | Steber et al. | 362/455 |
| 4,554,621 A | | 11/1985 | Corrigan | 362/382 |
| 4,750,097 A | | 6/1988 | Pringle et al. | 362/297 |
| 5,371,663 A | * | 12/1994 | Chuang | 362/280 |

FOREIGN PATENT DOCUMENTS

| | | |
|---|---|---|
| DE | 474859 | 4/1929 |
| DE | 26 18 310 B2 | 11/1977 |
| DE | 78 27 684 U1 | 1/1979 |
| DE | 81 19 544.3 U1 | 11/1981 |
| DE | 35 46 711 C2 | 4/1986 |
| DE | 40 05 355 C2 | 9/1991 |
| DE | 41 27 206 A1 | 2/1993 |
| DE | 44 11 198 A1 | 10/1995 |
| FR | 874542 | 8/1942 |
| FR | 2164549 | 8/1973 |
| FR | 2750196 | 12/1997 |
| WO | WO96/22490 | 7/1996 |

* cited by examiner

*Primary Examiner*—Stephen Husar
(74) *Attorney, Agent, or Firm*—Christie, Parker & Hale, LLP

(57) ABSTRACT

For changing a lamp in a lamphead, in particular a stage, studio, film and/or television lamphead, a cover component of the lamphead is opened by swivelling the cover component about a swivel axis. The swivel axis runs along a straight line which cuts the cover component in two points positioned at a distance apart from one another. In the case of a circular cover component, the two points are a secant of the cover component. The swivel axis preferably thereby runs near to the middle or even centrally or diametrically through the middle of the cover component. Preferably the straight line defining the swivel axis is vertical. The cover component does not have to be swivelled far to the side, upwards or downwards, but instead is swivelled partially into the case, whereby particularly in the case of limited space availability this leads to simplified handling of the lamphead, e.g. when the lamp is changed.

14 Claims, 3 Drawing Sheets

LAMPHEAD

CROSS-REFERENCE

This application claims priority of German Application No. 298 19 688.3 filed Oct. 29, 1998.

FIELD OF THE INVENTION

The invention relates to a lamphead, in particular a stage, film and/or television lamphead.

BACKGROUND OF THE INVENTION

Lampheads of this nature generally have a one-sided or two-sided socketed lamp which is positioned in a case, for example a discharge lamp (e.g. a halogen metal vapour lamp or a natrium high pressure vapour lamp), whereby the lamp in association with a reflector which is also positioned in the case beams the light in one direction through an opening in the case. For the purpose of protecting the lamp and/or for the purpose of modulating the light beamed, the front side of the case is thereby closed with a cover component held in a frame or a holder, whereby this cover component is preferably transparent (e.g. a protective disc or a lens).

For the purpose of changing the lamp, the case must be opened. This frequently occurs through swivelling the cover component facing the case round a swivel axis which lies roughly tangentially on the edge of the case. DE 40 05 355 C2 disclosed, for example, a beaming light whereby the cover disc is secured by its frame to two mounting rods which are guided by means of a push-swivel-bearing on the case. For the purpose of changing the lamp, the cover disc is first pushed in the beam direction away from the case, and is then swivelled round a swivel axis positioned tangentially on the edge of the case.

Particularly with large, professional studio or stage lampheads, whereby the cover components can be larger than 400 mm, the existing opening mechanisms have the disadvantage that great forces and moments are at work through the large radial range of the cover component. This can lead to difficulties with changing the lamp, particularly when the lamphead in use is positioned in such a way that it can only be accessed with difficulty, e.g. on a crane, a stand, a telescope or under the cover. Through the high forces and moments which arise during opening, the entire lamphead is swivelled out of its adjusted position, which means that time-consuming further adjustment is then necessary.

SUMMARY OF THE INVENTION

It is thus an object of the present invention to provide a type of lamphead which for the purpose of changing a lamp can be opened on its front side simply and with little force application, and whereby upon opening the front side only limited forces and moments are at work.

A lamphead, in particular a stage, studio, film and/or television lamphead, is thereby provided which has a lamp positioned in a case, and whereby on the front side of the case there is a cover component which is in most cases more or less transparent and which is preferably equipped with a holder. This cover component closes the case in the beam direction of the lamp, and for the purpose of opening the case (e.g. for changing the lamp) the cover component can be swivelled facing the case. According to the invention, the swivel axis of the cover component thereby runs along a straight line which cuts the cover component in two points (secant) positioned at a distance apart from one another. This is unlike existing models whereby the swivel axis is generally positioned tangentially on the edge of the case or the cover component. The swivel axis preferably thereby runs near to the middle or even centrally or diametrically through the middle of the cover component.

According to the invention, the swivel axis of the cover component is moved away from the edge of the lamphead and/or the cover component and in the direction of the middle of the lamphead and/or the cover component. This can occur both with rounded and with angular, e.g. square lampheads and cover components, whereby in the case of angular cross-sections reference must correctly be made not to a "secant", but instead for example to a straight line cutting the corresponding cross-section in two points.

The swivel axis is thus positioned in the area of the line bisecting the cover component, whereby the swivel direction of the cover component can be as one wishes. Preferably, however, the swivel axis will run vertically, in such a way that the cover component is swivelled horizontally. The area of the positioning of the swivel axis round the bisecting line includes the bisecting line. Preferably, however, the swivel axis will be positioned so far to the side of the bisecting line that when the cover component is opened this cover component with the smaller area is moved past, for example, a one-sided socketed lamp which is positioned in the middle of the lamphead reflector.

The solution according to the invention has the advantage that in the case of large and heavy cover components, like a lens (e.g. a Fresnel lens) or for example a plane disc serving as a protective disc, effect disc or filter disc, there is better weight distribution when the corresponding cover component is swivelled. As is otherwise generally the case, the cover component does not have to be swivelled far to the side, upwards or downwards, but instead is swivelled partially into the case, whereby particularly in the case of limited space availability this leads to simplified handling of the lamphead, e.g. when the lamp is changed.

In order to limit the opening angle, a catch is preferably provided. By swivelling the cover component, the case can thereby only be opened so wide as to ensure that the lamp cannot be damaged. The catch can, for example, be constituted by a securing pin or similar, or it can be already incorporated in the casting of the lamp case and/or the cover component or the frame thereof. It is also possible to have an adjustable catch, for variable adjustment of the maximum opening angle, e.g. by an adjustable securing bolt.

According to an embodiment of the invention, multiple cover components are combined together in a box, like for example a lens with a scattering disc and a dimming mechanism, whereby for the purpose of opening the case the complete box with all of the cover components can be swivelled round a swivel axis which runs along a secant of the cover components.

In a further embodiment of the invention, additional devices, e.g. separate color changers, dimming mechanisms or boxes with effect discs, filters and/or additional lenses, can be attached to the case and not to the swivelling cover component, nor to its swivelling holder or box. When the case is opened, the additional devices must not thereby be swivelled.

BRIEF DESCRIPTION OF THE DRAWINGS

Further advantages ensue from the embodiments of the invention described below. The drawings show.

DETAILED DESCRIPTION OF THE DRAWINGS

Figure 1:
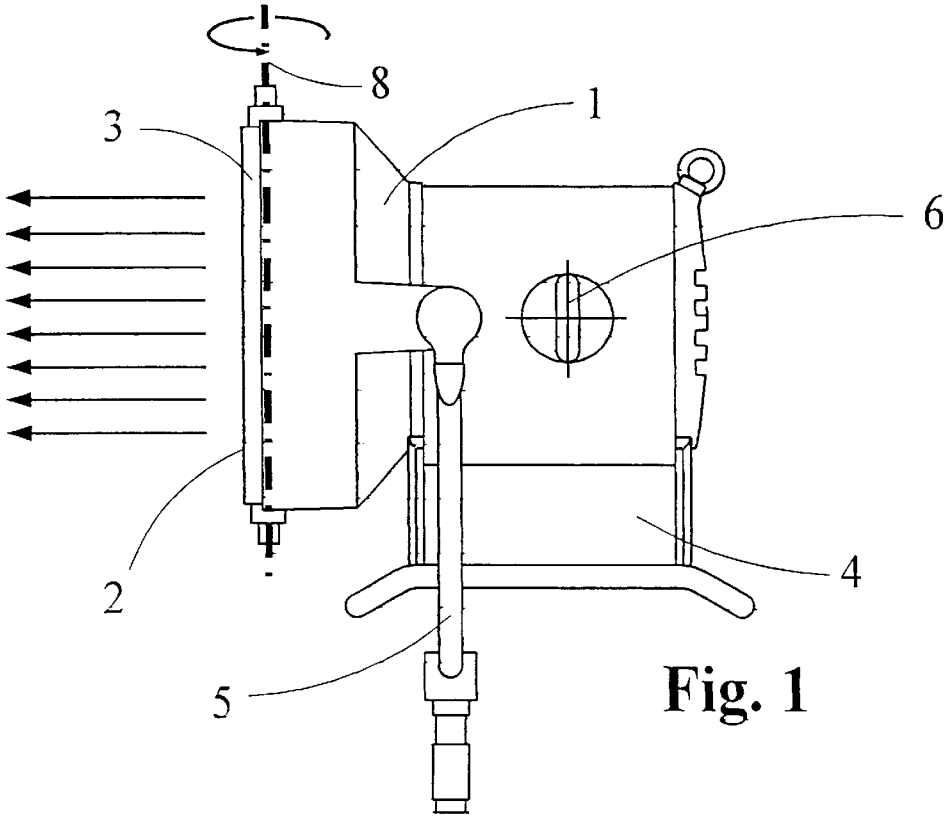
FIG. 1 is a side view of a lamphead with a closed cover component.
Figure 2:
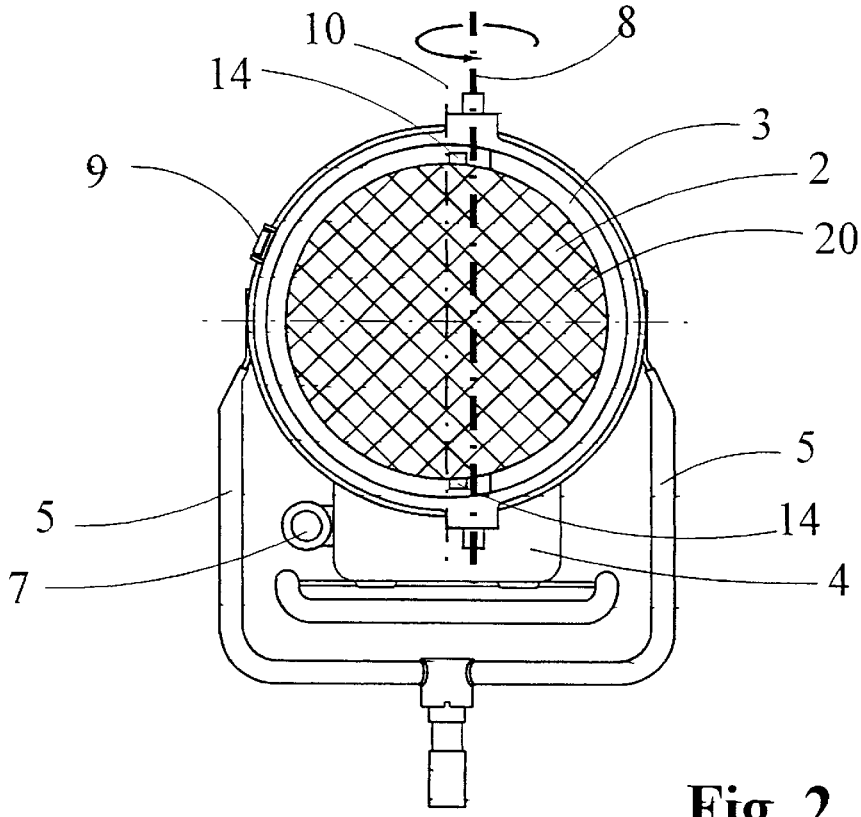
FIG. 2 is a front view of the lamphead according to FIG. 1.

FIGS. 1 and 2 show a side view (FIG. 1) and a front view (FIG. 2) of a stage, studio, film and/or television lamphead according to the invention. The lamphead has a case 1, on the front side of which in the beam emission direction (arrow) there is a transparent cover component 2 in the form of a plane disc 2 with a protective barrier 20. The plane disc 2 has a holder 3 and is positioned facing the case in such a way that it can be swivelled. On the case 1 there is a base 4 and two support bows 5. Furthermore, there is a lamp clamping button 6 which can be used from the outside and a cable input 7.

From the front view (FIG. 2) it can be seen that the plane disc 2 and its holder 3 can be swivelled around a swivel axis 8, whereby this swivel axis 8 has been displaced from the edge of the lamphead/the plane disc 2 in the direction of the bisecting line 10 of the plane disc 2. The swivel axis 8 therefore does not run along a tangent of the plane disc 2, for example through one of the support bows 5, as has been common practice up to now. Instead the swivel axis 8 runs along a secant of the lamphead/the plane disc 2. In the example illustrated, the swivel axis 8 does not run diametrally through the bisecting line of the plane disc 2, but instead it runs at a small distance from the bisecting line in such a way that the swivel axis 8 divides the plane disc 2 into two unequal areas, whereby the dimensions of the smaller area are such that when the cover component is opened the plane disc 2 with the smaller area is moved past, for example, a one-sided socketed lamp which is positioned in the middle of the lamphead reflector, and whereby the larger area yields a maximum free area for engaging in the lamphead, for example, for the purpose of changing the lamp. In a concrete embodiment, in the case of a lamphead with a component cover having a diameter of 500 mm, the swivel axis is positioned 70 mm to 100 mm from the bisecting line, i.e. "away from the middle".

This "away from the middle" positioning of the swivel axis has the previously mentioned advantage that there is more space available for changing the lamp of a one-sided socketed lamp. Also guaranteed are easy opening of the lamphead and a low torque burden of the lamphead case when the cover component is open. Through the wide opening of the cover component, the lamp, which is centrally positioned in a parabola-like reflector, can be grasped more easily by hand for the purpose of insertion and removal due to more space being available. The swivel movement for opening the illustrated lamphead is indicated by corresponding arrows.

By means of a shutter 9 on the edge of the lamphead, the plane disc 2/its holder 3 are protected from unwanted swivelling and from an opening of the case 1. Furthermore, there is a catch 14 for limiting the opening angle.

Figure 3:
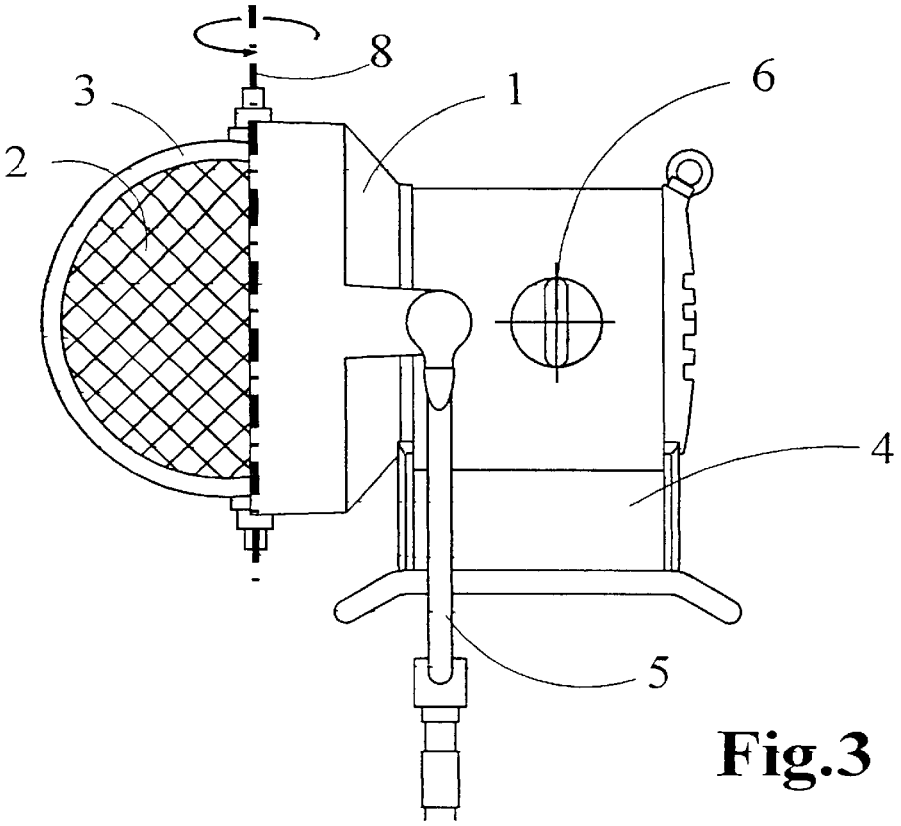
FIG. 3 is a side view of the lamphead according to FIG. 1 and FIG. 2 with an opened cover component.
Figure 4:
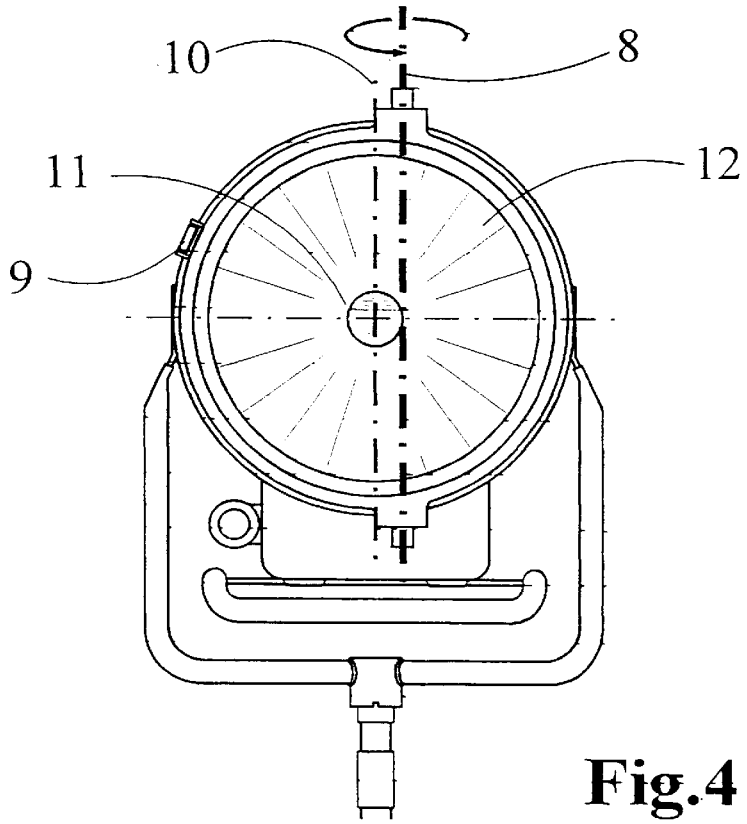
FIG. 4 is a front view of the lamphead according to FIG. 3.

FIG. 3 and FIG. 4 show a side view (FIG. 3) and a front view (FIG. 4) of the stage lamphead according to FIG. 1 and FIG. 2 with an open plane disc 2. The same components are thereby given the same references.

From FIG. 3 it can be seen that after the swivelling of the plane disc 2 and its holder 3, part of the plane disc 2 has been swivelled into the case 1. In the illustrated embodiment, the anti-clockwise swivelling direction for the swivelling which has already occurred for the purpose of opening the lamphead has been indicated with arrows. Due to the slightly asymmetrical positioning of the swivel axis (see FIG. 2 and FIG. 4), which arises from its small distance from the diametrically running bisecting line or symmetry line 10, the part of the plane disc 2 which swivels into the case 1 is smaller than the part of the plane disc 2 which swivels outwards and which is visible in FIG. 3.

In FIG. 4, whereby there is open, 90° swivelling of the holder 3 and plane disc 2, one can see a one-sided socketed lamp 11 positioned behind the plane disc 2, and one can also see a reflector 12 positioned behind the lamp 11. In order to give a better overall view, the side representation of the holder 3 has been omitted. With the plane disc opened, the lamp 11 can be easily changed, and the plane disc 2 and the holder 3 can then be swivelled back into their original position (FIG. 2) for the purpose of closing the case 1 again.

In comparison with the symmetrical positioning of the swivel axis 8 also according to the invention, which has the advantage of better weight distribution and the smallest moments when the case is opened, in the case of the illustrated slightly asymmetrical positioning of the swivel axis 8 there is a somewhat larger intervention opening (in FIG. 4 to the left of the swivel axis 8) for changing the lamp and security against damage or destruction of the reflector and/or the lamp 11 positioned centrally on or in the reflector. Moreover, the slightly asymmetrical swivel axis 8 allows closer positioning of the lamp 11 facing the plane disc 2 and also allows a smaller construction of the case 1, as the part of holder 3 and plane disc 2 which swivels into the case is smaller than when the swivel axis 8 is symmetrically positioned.

In contrast with a tangentially positioned swivel axis, in the illustrated embodiment of the invention there is considerably better weight distribution and as a result there are considerably lower forces and moments.

The opening angle of holder 3 and plane disc 2 does not definitely have to be 90° as illustrated in FIG. 3 and FIG. 4. Depending upon the accessibility of the lamp, it can also be greater or smaller. For this purpose, a catch (e.g. an adjustable securing bolt) can be provided, which limits the opening angle and thereby prevents an opening angle which is too large and thus leads to contact between the holder 3 and the lamp or the reflector and possible damage thereof. Likewise, the swivel axis 8 does not have to run vertically, as illustrated in the embodiment of the invention. It can also be horizontally or diagonally positioned.

Figure 5:
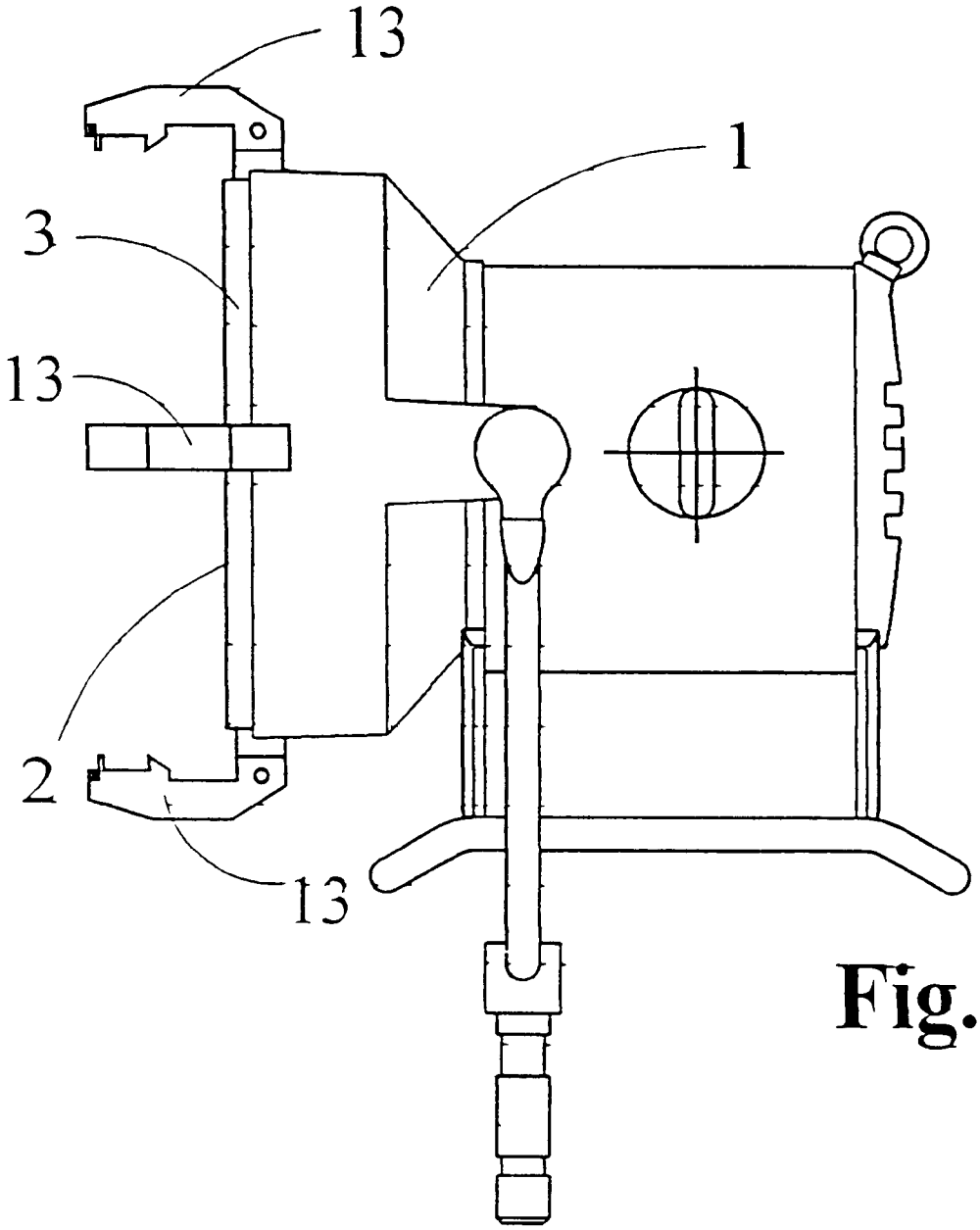
FIG. 5 is a side view of a lamphead with support claws.

FIG. 5 shows a lamphead which has on its front side several support claws 13 which are connected to the case 1, whereby on these support claws 13 additional devices can be connected to the case 1, independently of the swivelling cover component.

I claim:

1. A lamphead used in at least one of stage, studio, film and television lighting comprising:

a case, a lamp socket positioned in the case to receive a lamp, and a cover component which closes the case on a front side of the case in a beam direction of the lamp, wherein the cover component is positioned on the case in such a way that the cover component swivels to open the case, wherein a swivel axis of the cover component runs along a straight line which cuts the cover component in two points at a distance from one another.

2. A lamphead according to claim 1 wherein the swivel axis runs near to a bisecting line of the cover component.

3. A lamphead according to claim 1 wherein the swivel axis runs through a bisecting line of the cover component.

4. A lamphead according to claim 1 further comprising a catch limiting the opening angle of the cover component.

5. A lamphead according to claim 1 wherein the cover component is a lens.

6. A lamphead according to claim 1 wherein the cover component is a plane disc.

7. A lamphead according to claim 6 wherein the plane disc is at least one of toned and matted for the purpose of light filtering.

8. A lamphead according to claim 1, wherein the lamphead has support claws positioned on the periphery of the case for attaching additional devices to the lamphead.

9. A lamphead according to claim 1 wherein the swivel axis runs along a secant of the cover component.

10. A lamphead according to claim 1 wherein the cover component is a Fresnel lens.

11. A lamphead according to claim 1 wherein the straight line that cuts the cover component runs vertical.

12. A lamphead according to claim 1 wherein the cover component has a partial area that swivels into the case when the case is opened.

13. A lamphead according to claim 1 wherein the case has an opening in the front side that enables access to the lamp, wherein the swivel axis crosses the opening.

14. A lamphead according to claim 1 wherein the cover component has a translucent portion through which light beams from the lamp when the case is closed, wherein the swivel axis is across the translucent portion of the cover component.

* * * * *